United States Patent [19]

Snow et al.

[11] 4,307,735

[45] Dec. 29, 1981

[54] APPARATUS FOR BREAKING DOWN A MASS OF TOBACCO CONTAINING SOLID CARBON DIOXIDE

[75] Inventors: Ray G. Snow; Robert T. Gaudlitz, both of Richmond, Va.

[73] Assignee: Philip Morris, Incorporated, New York, N.Y.

[21] Appl. No.: 106,530

[22] Filed: Dec. 26, 1979

[51] Int. Cl.[3] ..... A24B 3/00; A24B 3/18

[52] U.S. Cl. ..... 131/290; 131/900; 62/320

[58] Field of Search ..... 131/146, 120, 290, 304, 131/306, 312, 900; 62/320

[56] References Cited

U.S. PATENT DOCUMENTS

| | | | |
|---|---|---|---|
| 2,952,391 | 9/1960 | Garland | 62/320 |
| 2,995,017 | 8/1961 | Breeding | 62/320 |
| 4,176,527 | 12/1979 | Liustromberg et al. | 62/320 |
| 4,192,151 | 3/1980 | Carpenter | 62/320 |

*Primary Examiner*—V. Millin

*Attorney, Agent, or Firm*—Arthur I. Palmer, Jr.; George E. Inskeep

[57] ABSTRACT

A substantially horizontal grating having a plurality of substantially parallel bars extends within an enclosure that is adapted to gravitationally receive a mass of tobacco containing a cryogen and discharge smaller tobacco particles therefrom. A plurality of rotatable shafts having a plurality of blades equally separated by spacers are disposed orthogonally over the parallel bars such that the blades are located between the parallel bars. The spacers on the shafts and the parallel bars cooperate to define a plurality of sized apertures through the grating. The blades are formed to separate portions of the mass upon rotation and to urge the portions through the sized apertures for discharge from the apparatus.

12 Claims, 7 Drawing Figures

APPARATUS FOR BREAKING DOWN A MASS OF TOBACCO CONTAINING SOLID CARBON DIOXIDE

BACKGROUND OF THE INVENTION

1. Field of the Invention

This invention relates to an apparatus for breaking a mass of substantially coherent tobacco containing solid cryogen such as carbon dioxide into smaller particles to facilitate transfer of such processed tobacco to subsequent processing equipment.

2. Description of the Prior Art

A process and apparatus for expanding tobacco by impregnation with a liquid cryogen, in particular, liquid carbon dioxide is described in patent applications U.S. Ser. No. 441,767 filed by Roger Z. de la Burde and Patrick E. Aument on Feb. 12, 1974 and U.S. Ser. No. 822,793, filed by Larry M. Sykes and Ray G. Snow on Aug. 8, 1977, both applications being assigned to the same asignee as is the present invention. As described in these applications, after the tobacco is thoroughly impregnated the excess liquid carbon dioxide is removed from the chamber in which the tobacco is processed and the liquid carbon dioxide is converted therein to solid carbon dioxide. The tobacco containing the solid carbon dioxide may be removed from the processing chamber and subjected to conditions of temperature and pressure, preferably by rapid heating at atmospheric pressure, to vaporize the solid carbon dioxide and thereby effect expansion.

In U.S. Pat. No. 4,165,618 to Lewis Tyree, Jr., issued on Aug. 28, 1979, apparatus is provided for removing a treated tobacco product containing solid carbon dioxide from a processing chamber by gravity through a hinged bottom door that allows the processed tobacco product to fall onto a conveyor or the like. The conveyor then transports the processed product to stations for further desired processing in a production-like fashion. One problem with discharging such processed tobacco to a moving conveyor occurs with the size of the processed product. In production, it is not uncommon to impregnate a charge of tobacco weighing up to 750 pounds. The charge of tobacco may gain an additional 10% of its weight after impregnation with the liquid carbon dioxide. Upon conversion to solid, the liquid carbon dioxide is caused to freeze. Since the liquid carbon dioxide is interspersed throughout the charge of tobacco there is a tendency upon solidification for the charge to coagulate into a substantially coherent mass or into several relatively large clumps of tobacco containing the solid carbon dioxide. Such a large mass or clumps of tobacco cannot be readily conveyed or transported to subsequent processing stations.

Before being transferred to a moving conveyor or the like it is therefore desirable, in particular with a large charge of tobacco, to break such a mass down into smaller particle sizes. Furthermore, it is desirable to break the mass down preferably into particles that have a maximum size to facilitate a controlled and gradual transfer to a moving conveyor or other processing equipment for subsequent processing of the tobacco. For example, for substantially even distribution to a moving conveyor, the processed tobacco is sometimes passed into and through a vibrating container. Clumps of tobacco too large for the infeed throat of the vibrating container would cause the throat to become clogged thereby backing-up the transfer process and ultimately requiring a stoppage of the production line.

SUMMARY OF THE INVENTION

In accordance with the invention, there is provided an apparatus for breaking a mass of substantially coherent tobacco containing solid cryogen into smaller particles having a predetermined maximum size. The apparatus comprises an enclosure having an open top and bottom adapted to gravitationally receive the mass of tobacco and discharge particles therefrom. Means are included in the enclosure for supporting the tobacco mass, the supporting means having a plurality of spaced members defining spaces therebetween. Disposed within the enclosure is rotative means for periodically contacting and separating a portion of the tobacco mass, the rotative means having means extending angularly across the spaced members to define therwith a plurality of sized apertures through the supporting means. The rotative means includes means for urging the separated portions through the sized apertures for discharge therefrom.

In the preferred form, the supporting means comprises a substantially horizontal grating having a plurality of substantially parallel bars extending substantially across the enclosure. A plurality of spaced substantially parallel rotatable shafts are disposed over and substantially orthogonal the direction of the parallel bars. A plurality of spaced elements, such as blades, are affixed on each of the shafts to rotate therewith, the blades being spaced on the shafts at locations in between the parallel bars, preferably centrally. The lengths of the blades are such that upon rotation thereof the blade extremities penetrate the plane defined by the upper surface of the grating. Each of the blades has means upon each revolution for periodically separating a portion of the tobacco mass and urging the portion through an opening in the grating defined by the distance between two adjacent parallel bars and the distance between two adjacent shafts.

DETAILED DESCRIPTION OF THE PREFERRED EMBODIMENTS

Figure 1:
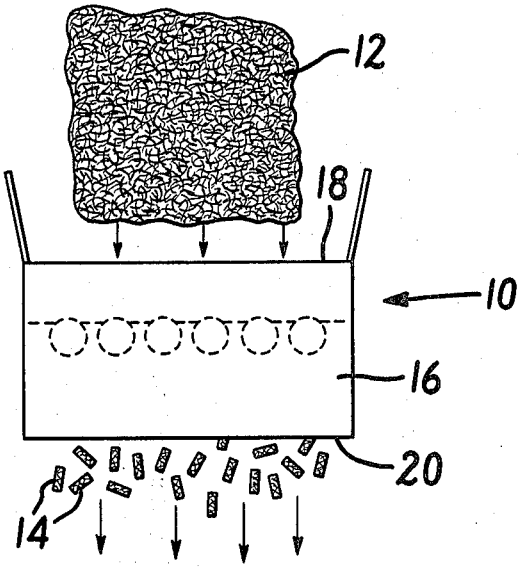
FIG. 1 is a side elevation view of the apparatus of the present invention showing in diagrammatic form the introduction of a mass of tobacco and the discharge of smaller tobacco particles.

Referring to the drawing, there is shown in FIG. 1 in accordance with the present invention an apparatus 10 for breaking a mass 12 of substantially coherent tobacco containing solid carbon dioxide or other cryogen into smaller particles 14 having a predetermined maximum size to facilitate transfer to a moving conveyor or other subsequent processing equipment. Such an apparatus 10 may be used, for example, in a process for treating a product such as tobacco with a liquid cryogen as described in patent applications U.S. Ser. No. 441,767 filed Feb. 12, 1974 and U.S. Ser. No. 822,793 filed Aug. 8, 1977 and U.S. Pat. No. 4,165,618 to Lewis Tyree, Jr., issued on Aug. 28, 1979. For use with such processes, the apparatus comprises an enclosure 16, preferably having four walls suitably supported by means not shown, and an open top 18 and bottom 20 to gravitationally receive the tobacco mass 12 and discharge the smaller particles 14 therefrom.

Figure 2:
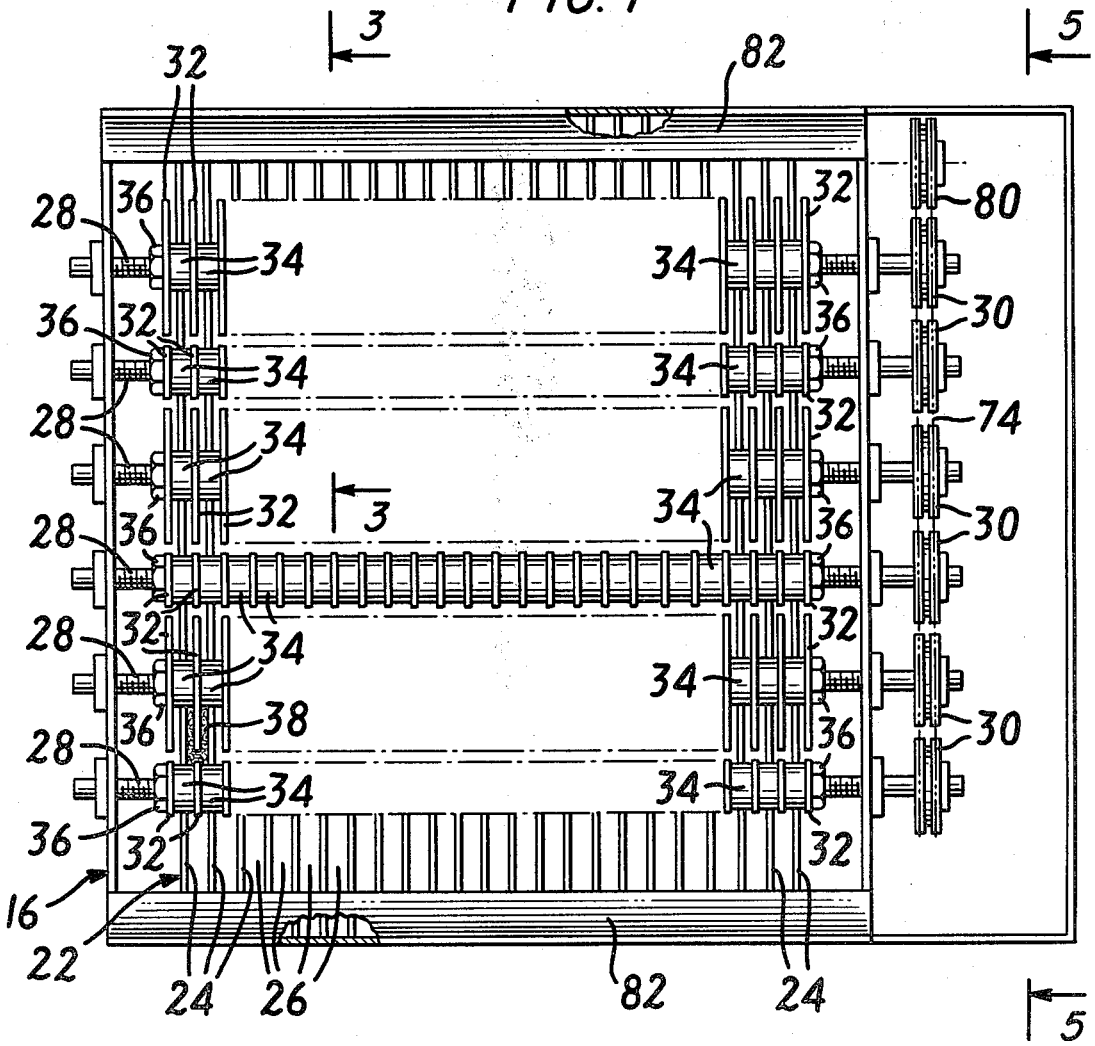
FIG. 2 is a plan view of the apparatus of the apparatus of FIG. 1 showing a plurality of rotatable shafts on which a plurality of blades are arranged for separating the tobacco mass.

Referring to FIG. 2, a metal grating 22 is included within the enclosure 16, the grating having a plurality of substantially parallel bars 24 that extend across the length of the enclosure 16, the bars 24 being spaced at predetermined intervals to extend nearly across the width of the enclosure 16. The grating 22 is suitably supported such that the parallel bars 24 are preferably substantially horizontal within the enclosure 16, the bars 24 being capable of supporting thereon a mass of tobacco weighing about 750 pounds. The bars 24 are preferably equally spaced to define therebetween a plurality of spaces 26 through the grating 22 and through which sized particles of tobacco are to be passed as will be described hereinafter.

Disposed over the grating as shown in FIG. 2 are a plurality of rotatable shafts 28 which may be any suitable number, the preferred arrangement having six shafts as illustrated. The shafts 28 are suitably supported on the enclosure 16 and are arranged to extend preferably orthogonally across the bars 24. The shafts 28 are further arranged to extend substantially parallel to each other with the center lines of adjacent shafts substantially equally spaced. A pulley 30, for example, is suitably affixed to one free end of each of the shafts 28 to impart rotation to the shafts 28 as will be described.

Disposed on each of the shafts 28 are a plurality of blades 32 for breaking down the mass of tobacco within the enclosure 16. The blades 32 are affixed on each shaft 32 to rotate therewith, the blades being preferably equally spaced and the spaced intervals preferably being substantially the same as intervals preferably being substantially the same as the interval between the grating bars 24. In the preferred form, the spacing between blades 32 is effected by a plurality of cylindrical spacers 34 that slide over each of the shafts 28 between each blade 32, each spacer 34 preferably having substantially the same height and outer diameter to provide the desired spacing. It is also preferable that the blades 32 be oriented on the shafts 28 and affixed thereto as by screws 36 such that the blades 32 on adjacent shafts 28 are aligned at locations that are substantially central with respect to each pair of parallel bars 24 of the grating 22.

As described and illustrated in FIG. 2, the grating 22 and the spacers 34 cooperate to define a particular size aperture through the grating 22. As identified in FIG. 2 by the shaded area 38, each of the sized apertures is defined by the area between two adjacent parallel bars 24 and the distance between the spacers 34 on two adjacent shafts 28. It should be appreciated that if the spacers 34 were not used, the distance would be that between the outer diameter of the two adjacent shafts 28. In the plan view shown in FIG. 2, the sized aperture 38 is substantially rectangular in projection. Such a sized aperture 38 represents the maximum size a separated portion of tobacco can would have as it passes through the grating 22.

Figure 3:
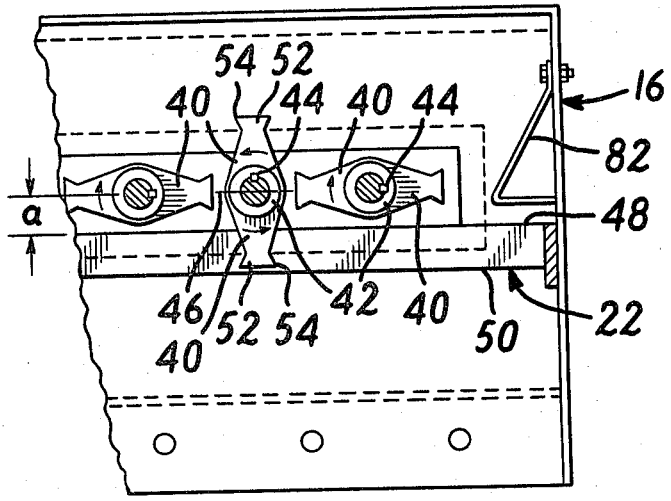
FIG. 3 is a fragmentary sectional view of the apparatus as seen along viewing lines 3—3 of FIG. 1.

As shown in FIG. 3, each of the blades 32 is preferably planar and is formed to have a pair of arms 40 that extend radially opposite each other. Each blade 32 has a hub 42 that is affixed to a shaft 28 as by a key 44. The shafts 28 are mounted on the enclosure so that their centerlines 46 are above the upper surface 48 of the grating 22 at a predetermined distance, a. The distance, a, depends upon the length of the blade arms 40 and is set so that the extremity of the blade 32 at the lowest point it reaches during rotation penetrates the plane defined by the upper surface 48 of the grating 22 between two parallel bars 24, the penetration preferably being near the bottom 50 of the grating 22.

Figure 4A:
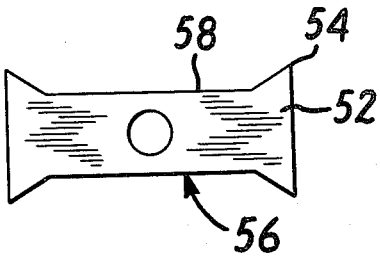
FIGS. 4(*a*), 4(*b*) and 4(*c*) are side elevation views of three various configurations of blades useful in the practice of the invention.
Figure 4C:
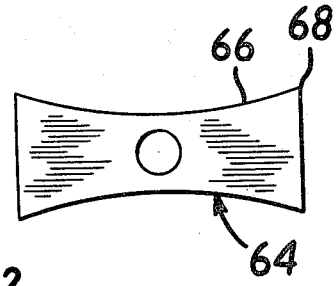
Figure 4B:
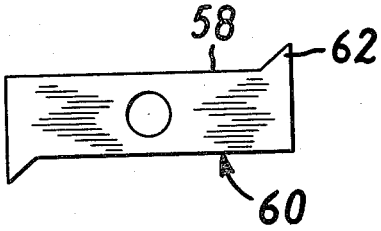

Each of the blades 32 is so formed as shown in FIG. 3 to contact the mass of tobacco as supported by the grating 22, to separate a portion of tobacco from the mass and urge the separated portion through the sized aperture 38. In the preferred embodiment, each of the blades 32 is formed such that the arms 40 taper in a direction toward its extremity. Near the extremity each arm 40 has a flared terminus 52 that diverges outwardly from the tapered portion and terminates at its extremity in a relatively sharp edge 54. During rotation of the blades 32 as formed, the sharp edge 54 strikes the mass and separates therefrom a portion of tobacco that, as the blade continues to rotate, is urged by the flared terminus 52 and the tapered arm through the grating 22 as by extrusion through the sized aperture 38 until the arm 40 substantially reaches its lowest point near the grating bottom 50. Although the blade 32 as described is preferred, other blade configurations or elements may also be used in the practice of the invention as shown, for example, in FIGS. 4(*a*), 4(*b*) and 4(*c*). The blade 56 in FIG. 4(*a*) may have a flared terminus 52 terminating in a sharp edge 54 and having substantially linear arms 58 rather than tapered. The blade 60 in FIG. 4(*b*) may be formed to have linear arms 58 as the blade 56 in FIG. 4(*a*), with only one flared section 62 on each arm rather than two. A blade 64 as illustrated in FIG. 4(*c*) may have its arms 66 diverging curvingly from its center terminating at its extremity in a relatively sharp edge 68.

The blades 32 as described are preferably formed to have substantially the same lengths, the blades 32 being arranged on each shaft 28 such that the arms 40 are aligned radially with each other along the longitudinal axis of the shaft 28. It is further preferable to orient the blades 32 on the shafts 28 such that during rotation when the arms 40 on alternate shafts 28 are substantially horizontal, the arms 40 on the other shafts 28 are substantially vertical.

Figure 5:
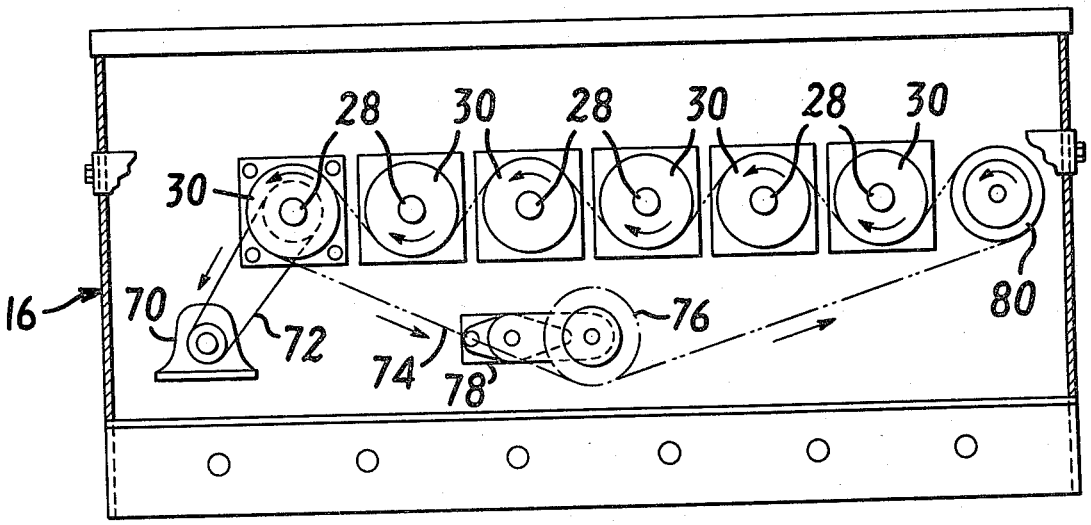
FIG. 5 is a side sectional view of the apparatus as seen along viewing lines 5—5 of FIG. 1.

In accordance with the invention, the shafts 28 are rotated as shown in FIG. 5 as by a motor 70 or other suitable drive means. In the illustrated preferred arrangement, alternating shifts 28 are caused to rotate in one direction with the other shafts 28 being rotated in the opposite direction. In such an arrangement, one of the pulleys 30, such as the end pulley, is coupled to the motor 70 as by a belt 72 to serve as the drive pulley. A continuous belt or chain passes over a pulley 76 in a tension providing device 78, around an idler pulley 80 and is then looped around the six pulleys 30 attached to the shaft 28 as shown in FIG. 5 to impart the alternating rotation. It should be appreciated that the configuration may be modified to permit other rotative movement of the shafts relative to each other, such as all being rotated in the same direction.

In operation, the mass of tobacco containing solid cryogen is fed by gravity into the enclosure 16 in the apparatus 10. Inclined brackets 82 (FIGS. 1 and 3) may be attached to the walls of the enclosure to guide the tobacco mass centrally toward the blades. The rotation of the shafts 28 and hence the blades 32 is commenced preferably as or before the mass of tobacco is introduced into the apparatus, although rotation of the blades can begin after the tobacco is introduced. As described herein, the rotating blades 32, particularly the terminus with the relatively sharp edge at the extremity of each arm 40 separates the mass of tobacco into portions upon each half revolution. The portions are then urged by the arms of the blades through the sized apertures such that a particle size is discharged that has a maximum size as determined by the size of the sized apertures.

In one arrangement, for example, of the illustrated apparatus, the six shafts 28 are spaced 8.0 inch apart and twenty four blades 32 are spaced equally on each of the shafts 28. The blades are formed of type 304 stainless steel, ¼ in. thick. The spacers 34 are formed to have an outer diameter of about 3.563 inch with a spacer height of about 1.937 inch. The parallel bars 24 are also spaced equally apart by a distance of 1.937. The enclosed working area of the apparatus 10 within the enclosure 16 is about 4½ feet by 5½ feet. At these dimensions, the maximum size aperture 38 through which the tobacco portions are urged is approximately 1.937 inch wide by 4.437 inch long. For the particular processing and production requirements it has been found that the preferred range of blade rotation is between 25 and 50 revolutions per minute. Lower rotational speed will break the mass down too slowly for efficient transfer to subsequent moving equipment in production line manner. Higher speeds can often result in degradation of the tobacco due to the rapid breaking and separating of the mass. A charge of about 750 pounds of tobacco containing solid carbon dioxide has been broken down into the desired smaller particles with the present apparatus in a matter of seconds by rotating the blades between 25 and 50 rpm.

What is claimed is:

1. An apparatus for breaking a mass of substantially coherent tobacco containing solid cryogen into smaller particles having a predetermined maximum size, comprising:

an enclosure having an open top and bottom adapted to gravitationally receive said tobacco mass and discharge said smaller particles;

means within said enclosure for supporting said tobacco mass, said supporting means including a plurality of spaced members defining a plurality of spaces through said supporting means;

rotative means disposed within said enclosure for periodically contacting and separating a portion of said tobacco mass, said rotative means having means extending angularly across said spaced members to define therewith a plurality of sized apertures, said rotative means including means for urging said separated portions through said sized apertures for discharge therefrom.

2. An apparatus for breaking a mass of substantially coherent tobacco containing solid carbon dioxide into smaller particles having a predetermined maximum size to facilitate transfer and enhance feed control to subsequent processing equipment, comprising:

an enclosure, having an open top and bottom adapted to gravitationally receive said tobacco mass and discharge said smaller particles;

a substantially horizontal grating having a plurality of substantially parallel bars within and extending substantially across said enclosure;

a plurality of spaced substantially parallel rotatable shafts disposed over and substantially orthogonal the direction of said parallel bars, a plurality of spaced elements on and affixed to rotate with each of said shafts, said elements being spaced on said shafts at locations in between the parallel bars of said grating, the lengths of said elements being such that upon rotation the extremities thereof penetrate the plane defined by the upper surface of said grating;

each of said elements having means upon each revolution thereof for periodically separating a portion of tobacco from said mass and urging said portion through the opening in said grating defined by the distance between two adjacent parallel bars and the distance between two adjacent shafts.

3. An apparatus according to claim 2, wherein said elements on said shafts and said parallel bars are substantially equally spaced.

4. An apparatus according to claim 3, wherein said elements are equally spaced by a plurality of cylindrical spacers on said shafts between each element, the opening through which said tobacco portion is urged being substantially rectangular in its planar projection, each said opening being defined by the distance between two adjacent parallel bars and the distance between the circumferential surface of adjacent spacers.

5. An apparatus according to claim 4, wherein each said element on said shafts comprises a substantially planar blade having a hub and two arms extending radially and substantially opposite each other.

6. An apparatus according to claim 5, wherein the arms of each blade taper in a direction away from the hub and wherein each tapering arm near its extremity diverges outwardly and terminates at its extremity in a relatively sharp edge.

7. An apparatus according to claim 6, wherein the longitudinal axis of each of said shafts is spaced relative to said grating such that the extremities of each arm extends nearly to the bottom surface of said grating upon each half revolution.

8. An apparatus according to claim 5, wherein the number of blades on each shaft is equal, the blades on each adjacent shaft being substantially aligned in the same plane with each other to penetrate the openings between the bars substantially centrally.

9. An apparatus according to claim 8, wherein the lengths of the arms of each blade are substantially equal, and wherein all the spaced blades on each shaft are arranged such that arms are in substantial radial alignment with each other along the longitudinal axis of each shaft.

10. An apparatus according to claim 9, wherein the aligned blades on each of said shafts are further arranged such that during rotation when the blades on alternating shafts are substantially horizontal the blades on the other shafts are substantially vertical.

11. An apparatus according to claim 10, wherein said alternating shafts are rotated in one direction and said other shafts are rotated in the opposite direction.

12. An apparatus according to claim 11, wherein all said shafts are rotated at the same speed.

* * * * *